US009599404B2

(12) United States Patent
Johnson

(10) Patent No.: US 9,599,404 B2
(45) Date of Patent: Mar. 21, 2017

(54) FLUID DIRECT CONTACT HEAT EXCHANGE APPARATUS AND METHOD

(71) Applicant: Neldon P. Johnson, Deseret, UT (US)

(72) Inventor: Neldon P. Johnson, Deseret, UT (US)

(73) Assignee: Black Night Enterprises, INC., Charleston, Nevis ( * ) Notice: Subject to any disclaimer, the term of this patent is extended or adjusted under 35 U.S.C. 154(b) by 527 days.

(21) Appl. No.: 14/010,854

(22) Filed: Aug. 27, 2013

(65) Prior Publication Data

US 2015/0060024 A1 Mar. 5, 2015

(51) Int. Cl.

| | |
|---|---|
| ***F28B 3/00*** | (2006.01) |
| ***F28C 3/02*** | (2006.01) |
| ***F28F 5/04*** | (2006.01) |
| ***F28D 19/04*** | (2006.01) |

(52) U.S. Cl.

CPC ..... *F28C 3/02* (2013.01); *F28D 19/042* (2013.01); *F28F 5/04* (2013.01)

(58) Field of Classification Search

CPC ..... F28C 3/02; F28C 3/18; F28C 3/00; F28C 3/04; F28C 3/06; F28D 19/042; F28D 19/047; F28D 19/048; F28F 5/00; F28F 5/02; F28F 5/04; F28F 5/06; F28F 13/003; F28F 13/12; F28F 13/125; F28B 3/00; F28B 3/06; F28B 3/08; F28B 3/04; C02F 1/10; B01D 3/34; B01D 3/40

USPC ..... 165/110, 111, 109.1, 104.18, 114, 92; 60/643, 645; 261/83–84, 94–95, 156; 366/325.6, 325.7; 202/234

See application file for complete search history.

(56) References Cited

U.S. PATENT DOCUMENTS

| | | | | | |
|---|---|---|---|---|---|
| 807,695 | A * | 12/1905 | Theisen | F24F 6/06 | 261/84 |
| 1,502,004 | A * | 7/1924 | Akins | C13B 20/007 | 261/21 |
| 3,211,148 | A * | 10/1965 | Galajda, Jr. | A61M 1/32 | 128/DIG. 3 |
| 3,227,649 | A * | 1/1966 | Ghormley | B01D 9/0009 | 165/111 |
| 3,348,829 | A * | 10/1967 | Grimes | B01F 3/04765 | 261/152 |
| 3,733,062 | A * | 5/1973 | Bracich | F24F 6/06 | 261/92 |
| 3,734,177 | A * | 5/1973 | Bellovary | F28D 9/0025 | 165/166 |

(Continued)

OTHER PUBLICATIONS

Liquids Specific Gravity—The Engineerign ToolBox—20120814.pdf.*

*Primary Examiner* — Etsub Berhanu
*Assistant Examiner* — Jose O Class-Quinones
(74) *Attorney, Agent, or Firm* — J. David Nelson

(57) ABSTRACT

A fluid direct contact heat exchanger having a contact chamber with a source fluid inlet provided by a source fluid inlet pipe, a source fluid outlet provided by a source fluid outlet pipe, a transfer fluid inlet provided by a transfer fluid inlet pipe, and a transfer fluid outlet provided by a transfer fluid outlet pipe. The source fluid and the transfer fluid have substantially different specific gravities and the source fluid and the transfer fluid are each insoluble in the other. The heat exchanger incorporates a heat transfer inducement element in the contact chamber which has a rotatable inducer shaft and a transfer accelerator element attached to the inducer shaft.

14 Claims, 3 Drawing Sheets

(56) References Cited

U.S. PATENT DOCUMENTS

| | | | | | |
|---|---|---|---|---|---|
| 3,804,155 | A | * | 4/1974 | Glicksman | F28D 19/045 165/133 |
| 3,999,596 | A | * | 12/1976 | Barnard | F28D 19/042 165/10 |
| 4,167,099 | A | | 9/1979 | Wahl, III et al. | |
| 4,272,960 | A | | 6/1981 | Wahl, III | |
| 4,458,747 | A | | 7/1984 | Berry et al. | |
| 4,616,698 | A | | 10/1986 | Klaren | |
| 4,621,684 | A | * | 11/1986 | Delahunty | F28D 11/02 165/120 |
| 5,488,836 | A | * | 2/1996 | Laude-Bousquet | F25C 1/14 165/92 |
| 6,119,458 | A | | 9/2000 | Harris et al. | |
| 7,059,130 | B2 | * | 6/2006 | Kawamura | F28F 13/003 165/165 |
| 8,281,592 | B2 | | 10/2012 | Kalina | |

* cited by examiner

FLUID DIRECT CONTACT HEAT EXCHANGE APPARATUS AND METHOD

BACKGROUND OF THE INVENTION

The present invention relates to apparatuses and methods for heat transfer from a fluid heat source and in particular relates to apparatuses and methods for the direct transfer of heat from a heat source fluid to a transfer fluid through direct contact.

Many apparatuses and methods for heat transfer from a heat source fluid, which is conveying heat from a heat source, to a transfer fluid, which may be conducting the heat to a device for performing work or inducing a process which requires heat, are known in the art. For purposes of this application, "source fluid" is defined to mean a fluid which is used to convey heat originating from a heat source. Also, for purposes of this application, "transfer fluid" is defined to mean a fluid which is used to convey heat away from a heat exchange with the source fluid to a device or process for utilizing the heat from the heat source.

The apparatuses and methods known in the prior art have met with varying degrees of success in transferring heat from a source fluid to a transfer fluid. There are many uses of heat which involve the transfer of heat from a source fluid to a transfer fluid. Those apparatuses and methods involve a substantial range of initial cost, cost of operation and maintenance, complexity, and efficiency.

Many of the apparatuses providing for the transfer of heat from a source fluid to a transfer fluid are very sensitive to the quality and characteristics of either the source fluid, the transfer fluid or both. For example, if the source fluid or the transfer fluid is water containing a high concentration of minerals, many common heat transfer apparatuses will experience a problem with the precipitation of minerals or corrosion from the highly mineralized water.

Many of the prior art apparatuses also have significant limitations regarding the rate of heat transfer and the efficiency of heat transfer from the source fluid to the transfer fluid, which limitations are due in part at least to the lack of direct contact between the source fluid and the transfer fluid. Although direct fluid contact is used for some prior art heat exchangers, such as common swamp coolers or cooling towers, such devices and methods are limited in use, and are particularly unsuited for use with a mineralized source fluid.

It is an objective of the present invention to provide an apparatus and method for the transfer of heat from a source fluid to a transfer fluid through direct contact between the source fluid and the transfer fluid.

It is a further objection of the present invention to provide an apparatus and method for the rapid and efficient transfer of heat from a source fluid to a transfer fluid through direct contact of the source fluid and the transfer fluid and through the use of a heat transfer inducement element.

A further objective of the present invention is to provide an apparatus and method for the transfer of heat from a source fluid to a transfer fluid which is economical as to initial cost as well as cost of operation and maintenance.

It is a still further objective of the present invention to provide an apparatus and method for the transfer of heat from a source fluid to a transfer fluid that provides for the use of a source fluid or a transfer fluid, or both, that are highly mineralized or corrosive.

A still further objection of the present invention is to provide an apparatus and method for transfer of the transfer of heat from a source fluid to a raw or mineralized water transfer fluid while avoiding precipitation and corrosion concerns associated with the use of the highly mineralized water for the transfer fluid.

It is a further objective of the present invention to provide an apparatus and method for the transfer of heat from a source fluid to a transfer fluid which allows the use of a highly mineralized water for the source fluid while eliminating or limiting the concerns regarding precipitation and corrosion associated with the use of mineralized water for the source fluid.

SUMMARY OF THE INVENTION

A preferred embodiment of a fluid direct contact heat exchanger of the present invention has a contact chamber having a source fluid inlet provided by a source fluid inlet pipe, a source fluid outlet provided by a source fluid outlet pipe, a transfer fluid inlet provided by a transfer fluid inlet pipe, and a transfer fluid outlet provided by a transfer fluid outlet pipe. For a preferred embodiment, the source fluid and the transfer fluid have substantially different specific gravities. Furthermore, for a preferred embodiment, the source fluid and the transfer fluid are each insoluble in the other. The source fluid may have a lower specific gravity than the transfer fluid or the source fluid may have a higher specific gravity than the transfer fluid.

A preferred embodiment of the heat exchanger also incorporates a heat transfer inducement element. The heat transfer inducement element may incorporate an inducer shaft and a transfer accelerator element, the transfer accelerator element being attached to the inducer shaft. For a preferred embodiment, the contact chamber has a cylindrical shape with a circular cross-section with a uniform chamber diameter. An inducer shaft has an inducer shaft axis which is aligned with a chamber axis centered longitudinally in the contact chamber. The inducer shaft passes through the first chamber end and second chamber end through a first fluid seal and a second fluid seal respectively. A first shaft bearing and a second shaft bearing provide for the positioning and rotation of the inducer shaft, the rotation of the inducer shaft being accomplished by a inducer drive mechanism attached to a first shaft end.

For a preferred embodiment, the transfer inducement element is comprised of an inducement matrix of copper wool or other similar high thermal conductivity matrix material which may be securely anchored to the inducer shaft by matrix anchors. Inducer shaft rotation provides for the transfer inducement element, the high thermal conductivity matrix material of the inducement matrix to rotate through the source fluid and the transfer fluid respectively thereby enhancing the heat transfer from the source fluid to the transfer fluid.

For a preferred embodiment, the heat exchanger source fluid flow direction is the same as the transfer fluid flow direction. For alternative embodiments, the transfer fluid flow direction may be opposite the source fluid source fluid flow direction. For a preferred embodiment, there is no attempt to mix the source fluid or the transfer fluid and the heat transfer occurs at the fluid contact surface and from the rotation of the inducement matrix from the source fluid into the transfer fluid. The contact chamber may have a quiescent zone at the chamber discharge end to provide for a complete separation of the source fluid and the transfer fluid.

An alternative preferred embodiment of the heat exchanger incorporates a transfer accelerator element with a collection of high thermal conductivity inducer blades affixed to the inducer shaft. For this embodiment, not only does the heat transfer inducement element enhance the heat transfer from the source fluid to the transfer fluid, it may also provide for temporary mixing of the source fluid and the transfer fluid, thereby further enhancing the transfer of heat from the source fluid to the transfer fluid. The amount of mixing afforded by the transfer inducement element may be controlled by controlling the inducer rotation rate.

The cylindrically shaped contact chamber of preferred embodiments may be contained by a cylindrical chamber pipe and opposing chamber caps which are fitted to the chamber pipe at respective chamber pipe ends. The chamber caps may be removed from the chamber pipe ends to provide for service, repair, removal and replacement of the transfer inducement element.

The heat exchanger and the heat exchange method of the present invention offer the advantage of eliminating the use of radiator like metallic heat exchange cores, a collection of metallic pipe coils, a collection of helical metallic tubes, or the like which interpose a thin, metallic, high heat transfer rate barrier between the source fluid and the transfer fluid. Such heat transfer devices are particularly susceptible to the deteriorating effects of a mineralized or corrosive source fluid or transfer fluid. The heat exchanger and heat exchange method of the present invention eliminate or greatly reduce he detrimental effects of mineral deposition or corrosion.

DETAILED DESCRIPTION OF PREFERRED EMBODIMENTS

Figure 1:
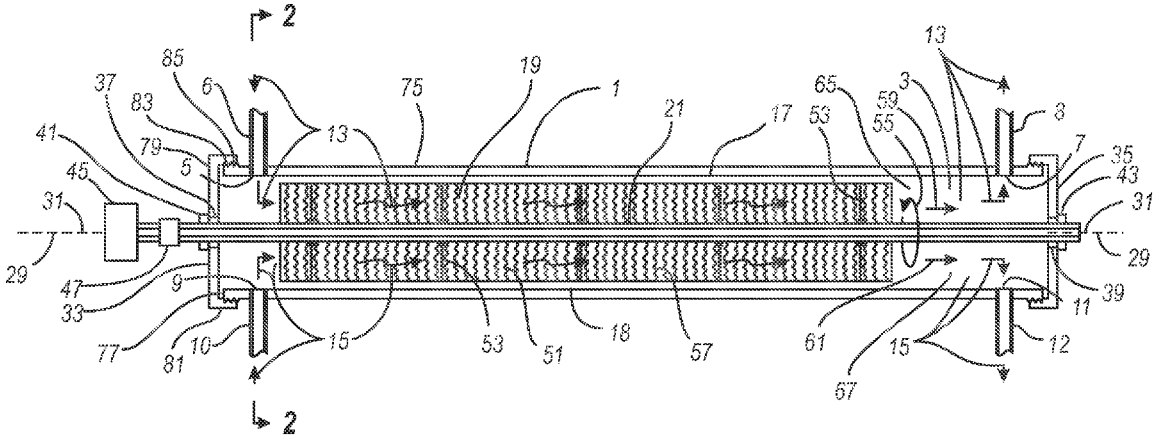
FIG. 1 is a longitudinal cross-section of a preferred embodiment of the fluid direct contact heat exchanger of the present invention incorporating a transfer inducement element which is an inducement matrix.

Referring first to FIG. 1, a preferred embodiment of a fluid direct contact heat exchanger 1 of the present invention is shown. The embodiment of the heat exchanger 1 shown in FIG. 1 has a contact chamber 3 having a source fluid inlet 5 provided by a source fluid inlet pipe 6, a source fluid outlet 7 provided by a source fluid outlet pipe 8, a transfer fluid inlet 9 provided by a transfer fluid inlet pipe 10, and a transfer fluid outlet 11 provided by a transfer fluid outlet pipe 12. For a preferred embodiment, the source fluid 13 and the transfer fluid 15 have substantially different specific gravities. Furthermore, for a preferred embodiment, the source fluid 13 and the transfer fluid 15 are each insoluble in the other. It should be noted that although for the embodiment of the heat exchanger 1 shown in FIG. 1, the source fluid 13 has a lower specific gravity than the transfer fluid 15 and therefore the source fluid inlet pipe 6 and the source fluid outlet pipe 8 are preferredly hydraulically connected at the contact chamber top 17 while the transfer fluid inlet pipe 10 and the transfer fluid outlet pipe 12 are preferredly hydraulically connected to the contact chamber bottom 18. end Alternative embodiments may provide for using a source fluid 13 that has a higher specific gravity than the transfer fluid 15, for which embodiments the source fluid inlet pipe and the source fluid outlet pipe would preferably be hydraulically connected to the contact chamber bottom 18 and the transfer fluid inlet pipe and the transfer fluid outlet pipe would preferably be hydraulically connected to the contact chamber top 17. Other alternative embodiments may provide for the higher specific gravity fluid of the source fluid and the transfer fluid to be introduced to the contact chamber near the contact chamber top 17 and for the lower specific gravity fluid of the source fluid and the transfer fluid to be introduced to the contact chamber near the contact chamber bottom 18. This may cause some initial mixing of the source fluid and the transfer fluid, and, thereby, enhance the initial rate of heat transfer from the source fluid to the transfer fluid.

Figure 2:
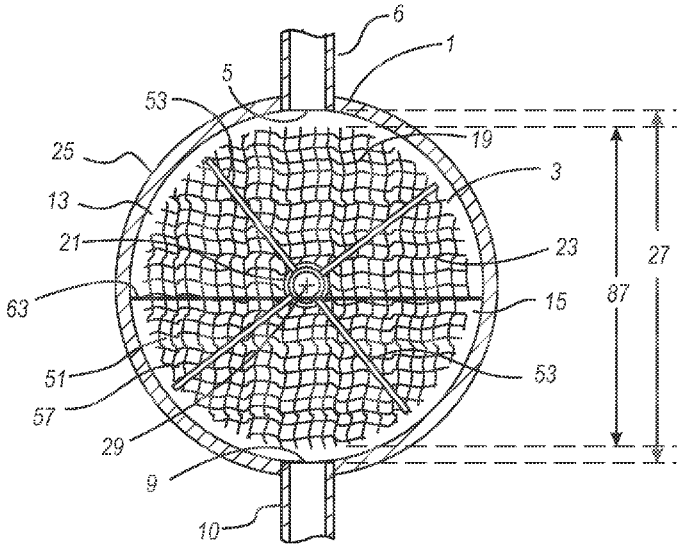
FIG. 2 is a lateral cross-section of the preferred embodiment of the fluid direct contact heat exchanger of the present invention shown in FIG. 1 which incorporates a transfer inducement element which is an inducement matrix.

Referring also to FIG. 2, the preferred embodiment of the heat exchanger 1 also incorporates a heat transfer inducement element 19. For the embodiment shown the heat transfer inducement element 19 incorporates an inducer shaft 21, transfer accelerator element 23, the transfer accelerator element 23 being attached to the inducer shaft 21. The contact chamber 3 for the preferred embodiment shown in FIGS. 1 and 2 has a cylindrical shape with a circular cross-section with a uniform chamber diameter 27. The inducer shaft 21 has an inducer shaft axis 29 which is aligned with a chamber axis 31 centered longitudinally in the contact chamber 3. The inducer shaft 21 passes through the first chamber end 33 and second chamber end 35 through a first fluid seal 37 and a second fluid seal 39 respectively. A first shaft bearing 41 and a second shaft bearing 43 provide for the positioning and rotation of the inducer shaft, the rotation of the inducer shaft being accomplished by a inducer drive mechanism 45 attached to a first shaft end 47. The inducer drive mechanism 45 may incorporate an electric motor and a gear box, variable speed drive, or other manual or automated mechanisms that will be known to persons of skill in the art for rotating the transfer inducement element at an inducer rotation rate 71 selected by an operator or determined autonomously based upon the operating conditions, such as source fluid temperature, transfer fluid temperature, source fluid flow rate, and transfer fluid flow rate, as sensed by operating condition sensors.

For the preferred embodiment shown in FIGS. 1 and 2, the transfer inducement element 19 is comprised of an inducement matrix 51 of copper wool or other similar high thermal conductivity matrix material 57 which may be securely anchored to the inducer shaft 21 by matrix anchors 53. Inducer shaft rotation 55 provides for the transfer inducement element 19, the high thermal conductivity matrix material 57 of the inducement matrix 51 for the embodiment shown in FIGS. 1 and 2, to rotate through the source fluid 13 and the transfer fluid 15 respectively thereby enhancing the heat transfer from the source fluid to the transfer fluid. Simplified embodiments may provide for a fixed, non-rotating transfer inducement element 19 that may be suspended in the contact chamber 3 by an inducer shaft positioned similar to the position of the inducer shaft 21 as shown in FIGS. 1-6, or may simply rest on the contact chamber bottom 18.

For the embodiment shown in FIG. 1, the heat exchanger source fluid flow direction 59 is the same as the transfer fluid flow direction 61. For alternative embodiments, the transfer fluid flow direction may be opposite the source fluid source fluid flow direction. For the embodiment shown in FIG. 1, there is no attempt to mix the source fluid or the transfer fluid and the heat transfer occurs at the fluid contact surface 63 and from the rotation of the inducement matrix 51 from the source fluid 13 into the transfer fluid 15. The contact chamber may have a quiescent zone 65 at the chamber discharge end 67 to provide for a complete separation of the source fluid 13 and the transfer fluid 15 before discharge from the contact chamber 3.

Figure 3:
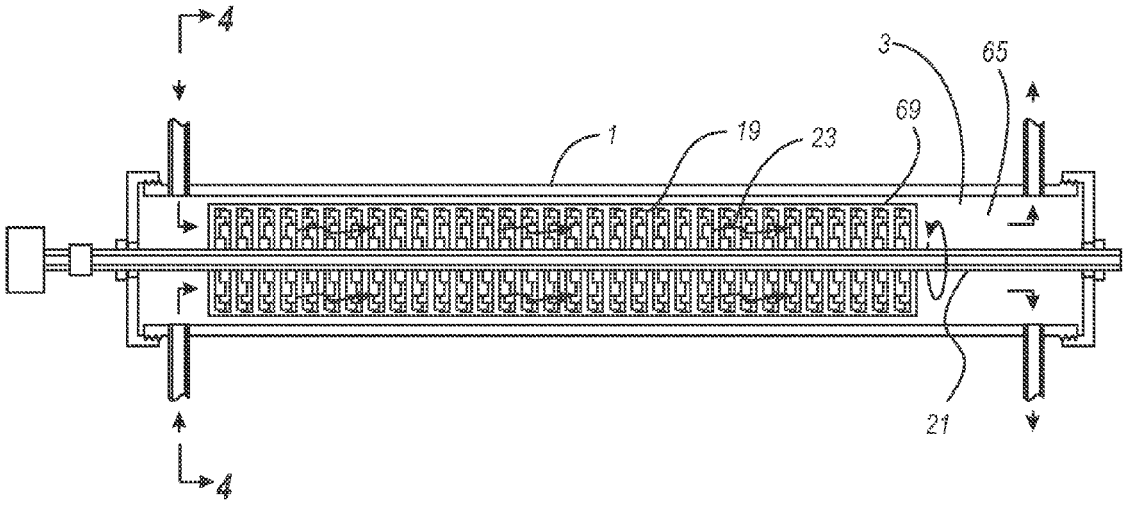
FIG. 3 is a longitudinal cross-section of an alternative preferred embodiment of the fluid direct contact heat exchanger of the present invention incorporating a transfer inducement element with a transfer accelerator element having a collection of high thermal conductivity inducer blades affixed to an inducer shaft.
Figure 4:
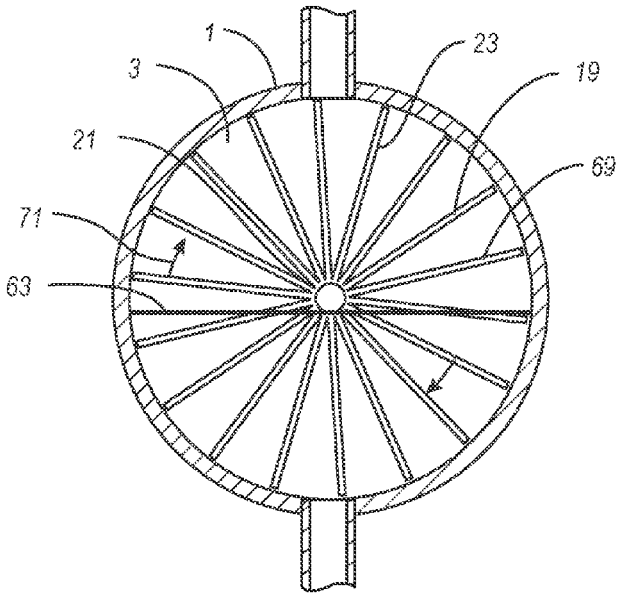
FIG. 4 is a lateral cross-section of the alternative preferred embodiment of the fluid direct contact heat exchanger of the present invention shown in FIG. 3 incorporating a transfer inducement element with a transfer accelerator element having a collection of high thermal conductivity inducer blades affixed to an inducer shaft.

Referring now to FIG. 3, an alternative preferred embodiment of the heat exchanger 1 having a contact chamber 3 with an alternative heat transfer inducement element 19 incorporating a transfer accelerator element 23 with a collection of high thermal conductivity inducer blades 69 affixed to the inducer shaft 21 is shown. For this embodiment, not only does the heat transfer inducement element 19 enhance the heat transfer from the source fluid 13 to the transfer fluid 15, it may also provide for temporary mixing of the source fluid 13 and the transfer fluid 15, thereby further enhancing the transfer of heat from the source fluid 13 to the transfer fluid 15. The amount of mixing afforded by the transfer inducement element 19 may be controlled by controlling the inducer rotation rate 71. Obviously the greater the number of inducement blades 69, the greater the enhancement that may be provided by the transfer inducement element 19. Increasing the number of inducer blades 69 may also result in an increase in the level of mixing between the source fluid and the transfer fluid. The inclusion of a chamber quiescent zone 65 will be even more critical for the embodiment of FIG. 3 than for the embodiment of FIG. 1, due to the intentional mixing that may be provided by this embodiment of the transfer inducement element 19.

Referring again to FIG. 1 and also to FIG. 2, a preferred embodiment of the inducement matrix 51 may incorporate a copper wool or other wool-like material composed of high thermal conductivity metal strands or fibers and may incorporate matrix anchors 53 extending radially from the inducer shaft 21 to provide more rigidity and stability to the inducer matrix 51.

Figure 5:
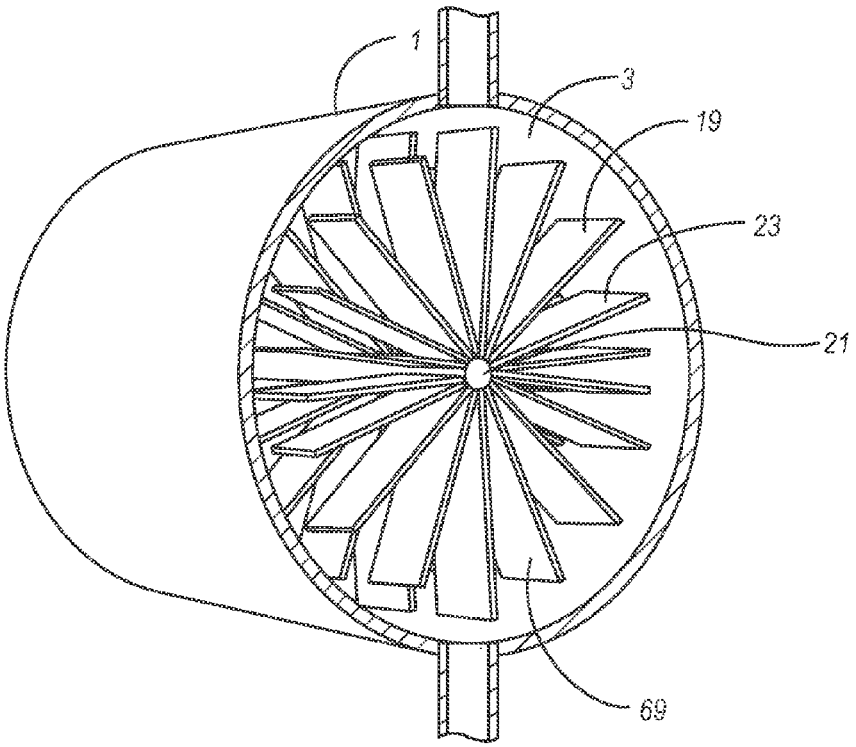
FIG. 5 is a vertical side perspective view of the alternative preferred embodiment of the fluid direct contact heat exchanger of the present invention shown in FIGS. 3-4 incorporating a transfer inducement element with a transfer accelerator element having a collection of high thermal conductivity inducer blades affixed to an inducer shaft.
Figure 6:
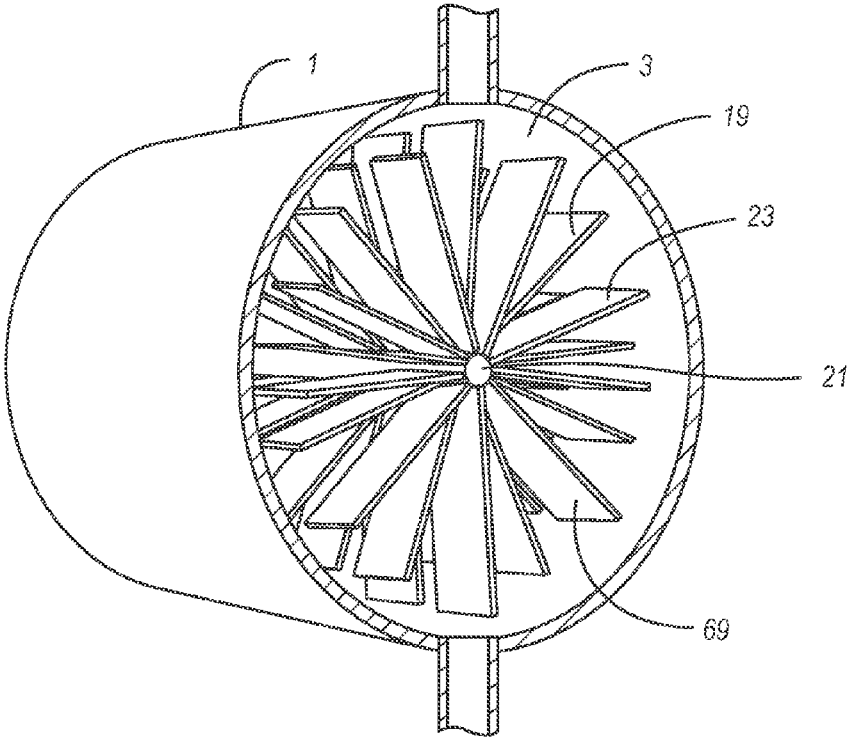
FIG. 6 is a vertical side perspective view of the alternative preferred embodiment of the fluid direct contact heat exchanger of the present invention shown in FIGS. 3-4 incorporating a transfer inducement element with a transfer accelerator element having a collection of high thermal conductivity inducer blades affixed to an inducer shaft, the inducer blades having a staggered placement on the inducer shaft.

Referring now to FIGS. 5 and 6, an alternative preferred embodiment of the inducer matrix 51, which incorporates a plurality of inducer blades 69, may utilize inducer blades of a variety of designs, including blades of varying blade length 75 and varying blade thickness 77. The blades may be staggered on the inducer shaft 21 as shown in FIG. 6 or regularly aligned as shown in FIG. 5. The blades may also have a variable thickness, decreasing in thickness with radial distance from the inducer shaft 21. This may provide for increasing the stability of the blades in rotation, without increasing the amount of metal in the blades. Other embodiments may also provide for a stiffener at the connection of the inducer blades with the inducer shaft to provide strength and stability to the blades.

Referring again to FIGS. 1 and 3, the cylindrically shaped contact chamber 3 of preferred embodiments may be contained by a cylindrical chamber pipe 75 and opposing chamber caps 79 which are fitted to the chamber pipe 75 at respective chamber pipe ends 77. For the embodiments shown in FIG. 1 and FIG. 3, the chamber caps 79 have chamber cap ends 81 with internal chamber cap end threads 85 and the chamber pipe ends 77 have external chamber pipe end threads 83, and the chamber caps 79 may be removably fitted to the chamber pipe ends 77 respectively by being threaded onto the chamber pipe ends 77. The chamber caps 79 may be removed from the chamber pipe ends 77 to provide for service, repair, removal and replacement of the transfer inducement element 19. In view of the disclosures of this specification and the drawings, other embodiments of the contact chamber 3 may incorporate a chamber pipe 75 with chamber caps 79 affixed to the respective chamber pipe ends 77 in other ways known to persons of skill in the art, which will provide for the service, repair, removal and replacement of the transfer inducement element 19. Alternative embodiments may also provide for the source fluid inlet 5, the source fluid outlet 7, the transfer fluid inlet 9, and the transfer fluid outlet 11, or one or more of them, to be hydraulically connected to the contact chamber 3 through the respective chamber caps 79. For those embodiments, depending on whether the source fluid 13 or the transfer fluid 15 has a higher specific gravity, the source fluid outlet 7 or the transfer fluid outlet 11 may be positioned proximal to the top of the chamber cap 79 and the adjacent contact chamber top 17 and the other outlet positioned proximal to the bottom of the chamber cap 79 and the adjacent contact chamber bottom 18, rather than being hydraulically connected to the contact chamber 3 through the contact chamber top 17 or contact chamber bottom 18.

In view of the disclosures of this specification and the drawings, other embodiments of the transfer inducement element 19 will be known to persons of ordinary skill in the art, which will enhance the transfer of energy from the source fluid 13 to the transfer fluid 15.

Further, in view of the disclosures of this specification and the drawings, other embodiments of the contact chamber 3 with a cross-section that accommodates a transfer inducement element 19 which is rotatable through the fluid contact surface 63 will be known to persons of skill in the art. While a cylindrically shaped contact chamber 3, as shown in FIGS. 1-6, is preferred, other embodiments may incorporate other cross-sections, such as a square cross-section wherein the width and height of the contact chamber 3 is greater than the inducement element diameter 87 of the transfer inducement element 19.

For preferred embodiments of the fluid direct contact heat exchanger 1 and the method of the present invention, the source fluid 13 and the transfer fluid 15 are both non-compressible fluids. The present invention will preferably be operated under pressure and temperature ranges that both the source fluid 13 and the transfer fluid 15 will remain in a liquid phase at all times. However, alternative embodiments may provide for either the source fluid 13 or the transfer fluid 15, or both, to be a compressible fluid or to operate with either the source fluid 13 or the transfer fluid 15, or both, to be in a gaseous phase for all or a portion of the fluid cycle through the contact chamber 3.

Alternative embodiments of the fluid direct contact heat exchanger 1 of the present invention may provide for the source fluid inlet 5 and the transfer fluid inlet 9 to be combined, thereby providing for combining and mixing of the source fluid 13 and the transfer fluid 15 before the source fluid 13 and the transfer fluid 15 are introduced into the contact chamber 3. This may enhance and expedite the heat transfer from the source fluid 13 to the transfer fluid 15. For certain embodiments or applications of the embodiments, thorough mixing, mechanically or hydraulically, of the source fluid 13 and the transfer fluid 15 prior to or immediately after introduction of the source fluid 13 and the transfer fluid 15 to the contact chamber 3, may provide for a reduction in the required retention time of the source fluid 13 and the transfer fluid 15, and, therefore, the size of the contact chamber, or may provide for a reduction of or the elimination of the transfer inducement element 19.

The heat exchanger 1 and the heat exchange method of the present invention offer the advantage of eliminating the use of radiator like metallic heat exchange cores, a collection of metallic pipe coils, a collection of helical metallic tubes, or the like for commonly known heat exchangers, which interpose a thin, metallic, high heat transfer rate barrier between the source fluid and the transfer fluid. Such heat transfer devices are particularly susceptible to the deteriorating effects of a mineralized or corrosive source fluid or transfer fluid. The heat exchanger 1 and heat exchange method of the present invention may greatly reduce the detrimental effects of mineral deposition or corrosion. The selection of an appropriate source fluid may be critical for such an application involving a mineral laden or corrosive laden transfer fluid in order to prevent transfer of the minerals or corrosives to the source fluid. Likewise, the selection of an appropriate transfer fluid may be critical for such an application involving a mineral laden or corrosive laden source fluid in order to prevent transfer of the minerals or corrosives to the transfer fluid.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A fluid direct contact heat exchanger for transferring heat between a source fluid and a transfer fluid, the source fluid and the transfer fluid being of differing specific gravities, the source fluid having a higher specific gravity than the transfer fluid, the fluid direct contact heat exchanger comprising:

a contact chamber having a first chamber end, a second chamber end, a contact chamber top, and a contact chamber bottom;

a source fluid inlet hydraulically connected to the contact chamber proximal to the first chamber end;

a transfer fluid inlet hydraulically connected to the contact chamber proximal to the first chamber end;

a heat transfer inducement element positioned in the contact chamber, the heat transfer inducement element having an inducer shaft, an inducer drive mechanism, and an inducement matrix, the inducement matrix being attached to the inducer shaft, and the inducer drive mechanism having a capability for rotating the inducer shaft and for repetitively rotating the inducement matrix through the source fluid and the transfer fluid respectively, the inducement matrix comprising an open matrix of matrix material, the matrix material comprising a metallic wool of metal strands or fibers and providing for direct contact of the matrix material with the source fluid and the transfer fluid respectively as the inducement matrix is rotated through the source fluid and the transfer fluid respectively;

a transfer fluid outlet hydraulically connected to the contact chamber proximal to the second chamber end and proximal to the contact chamber top; and a source fluid outlet hydraulically connected to the contact chamber proximal to the second chamber end and proximal to the contact chamber bottom.

2. The fluid direct contact heat exchanger recited in claim 1 wherein the contact chamber is cylindrical in shape.

3. The fluid direct contact heat exchanger recited in claim 1 wherein the source fluid inlet is positioned proximal to the contact chamber top and the transfer fluid inlet is positioned proximal to the contact chamber bottom.

4. The fluid direct contact heat exchanger recited in claim 1 wherein the source fluid inlet is positioned proximal to the contact chamber bottom and the transfer fluid inlet is positioned proximal to the contact chamber top.

5. The fluid direct contact heat exchanger recited in claim 1 wherein the contact chamber is cylindrically shaped and has a chamber longitudinal axis centered in the contact chamber, the inducer shaft extending from the first chamber end to the second chamber end and being rotably secured to the first chamber end by a first shaft bearing and to the second chamber end by a second shaft bearing, the inducer shaft having a first fluid seal sealing a first passage of the inducer shaft through the first chamber end and a second shaft seal sealing a second passage of the inducer shaft through the second chamber end, the inducer drive mechanism being connected to an end of the inducer shaft.

6. The fluid direct contact heat exchanger recited in claim 1 wherein the inducement matrix comprises copper wool.

7. A fluid direct contact heat exchanger for transferring heat between a source fluid and a transfer fluid, the source fluid and the transfer fluid being of differing specific gravities, the source fluid having a lower specific gravity than the transfer fluid, the fluid direct contact heat exchanger comprising:

a contact chamber having a first chamber end, a second chamber end, a contact chamber top and a contact chamber bottom;

a source fluid inlet hydraulically connected to the contact chamber proximal to the first chamber end;

a transfer fluid inlet hydraulically connected to the contact chamber proximal to the first chamber end;

a heat transfer inducement element positioned in the contact chamber, the heat transfer inducement element having an inducer shaft, an inducer drive mechanism, and an inducement matrix, the inducement matrix being attached to the inducer shaft, and the inducer drive mechanism having a capability for rotating the inducer shaft and for repetitively rotating the inducement matrix through the source fluid and the transfer fluid respectively, the inducement matrix comprising an open matrix of matrix material, the matrix material comprising a metallic wool of metal strands or fibers and providing for direct contact of the matrix material with the source fluid and the transfer fluid respectively as the inducement matrix is rotated through the source fluid and the transfer fluid respectively;

a transfer fluid outlet hydraulically connected to the contact chamber proximal to the second chamber end and proximal to the contact chamber bottom; and a source fluid outlet hydraulically connected to the contact chamber proximal to the second chamber end and proximal to the contact chamber top.

8. The fluid direct contact heat exchanger recited in claim 7 wherein the contact chamber is cylindrical in shape.

9. The fluid direct contact heat exchanger recited in claim 7 wherein the source fluid inlet is positioned proximal to the contact chamber top and the transfer fluid inlet is positioned proximal to the contact chamber bottom.

10. The fluid direct contact heat exchanger recited in claim 7 wherein the source fluid inlet is positioned proximal to the contact chamber bottom and the transfer fluid inlet is positioned proximal to the contact chamber top.

11. The fluid direct contact heat exchanger recited in claim 7 wherein the contact chamber is cylindrically shaped and has a chamber longitudinal axis centered in the contact chamber, the inducer shaft extending from the first chamber end to the second chamber end and being rotably secured to the first chamber end by a first shaft bearing and to the second chamber end by a second shaft bearing, the inducer shaft having a first fluid seal sealing a first passage of the inducer shaft through the first chamber end and a second shaft seal sealing a second passage of the inducer shaft through the second chamber end, the inducer drive mechanism being connected to an end of the inducer shaft.

12. The fluid direct contact heat exchanger recited in claim 7 wherein the inducement matrix comprises copper wool.

13. Method for fluid direct contact heat exchange for transferring heat between a source fluid and a transfer fluid, the source fluid and the transfer fluid being of differing specific gravities, the source fluid having a higher specific gravity than the transfer fluid, the method comprising:

introducing the source fluid and the transfer fluid to a contact chamber having a first chamber end, a second chamber end, a contact chamber top and a contact chamber bottom, the source fluid being introduced by a source fluid inlet hydraulically connected to the contact chamber proximal to the first chamber end, and the transfer fluid being introduced by a transfer fluid inlet hydraulically connected to the contact chamber proximal to the first chamber end;

passing all or a portion of the source fluid and all or a portion of the transfer fluid through a heat transfer inducement element positioned in the contact chamber, the heat transfer inducement element having an inducer shaft, an inducer drive mechanism, and an inducement matrix, the inducement matrix being attached to the inducer shaft, and the inducer drive mechanism having a capability for rotating the inducer shaft and for repetitively rotating the inducement matrix through the source fluid and the transfer fluid respectively, the inducement matrix comprising an open matrix of matrix material, the matrix material comprising a metallic wool of metal strands or fibers and providing for direct contact of the matrix material with the source fluid and the transfer fluid respectively as the inducement matrix is rotated through the source fluid and the transfer fluid respectively;

discharging the transfer fluid from a transfer fluid outlet hydraulically connected to the contact chamber proximal to the second chamber end and proximal to the contact chamber top; and discharging the source fluid from a source fluid outlet hydraulically connected to the contact chamber proximal to the second chamber end and proximal to the contact chamber bottom.

14. Method for fluid direct contact heat exchange for transferring heat between a source fluid and a transfer fluid, the source fluid and the transfer fluid being of differing specific gravities, the source fluid having a lower specific gravity than the transfer fluid, the method comprising:

introducing the source fluid and the transfer fluid to a contact chamber having a first chamber end, a second chamber end, a contact chamber top and a contact chamber bottom, the source fluid being introduced by a source fluid inlet hydraulically connected to the contact chamber proximal to the first chamber end, and the transfer fluid being introduced by a transfer fluid inlet hydraulically connected to the contact chamber proximal to the first chamber end;

passing all or a portion of the source fluid and all or a portion of the transfer fluid through a heat transfer inducement element positioned in the contact chamber, the heat transfer inducement element having an inducer shaft, an inducer drive mechanism, and an inducement matrix, the inducement matrix being attached to the inducer shaft, and the inducer drive mechanism having a capability for rotating the inducer shaft and for repetitively rotating the inducement matrix through the source fluid and the transfer fluid respectively, the inducement matrix comprising an open matrix of matrix material, the matrix material comprising a metallic wool of metal strands or fibers and providing for direct contact of the matrix material with the source fluid and the transfer fluid respectively as the inducement matrix is rotated through the source fluid and the transfer fluid respectively;

discharging the transfer fluid from a transfer fluid outlet hydraulically connected to the contact chamber proximal to the second chamber end and proximal to the contact chamber bottom; and discharging the source fluid from a source fluid outlet hydraulically connected to the contact chamber proximal to the second chamber end and proximal to the contact chamber top.

* * * * *